US008602678B2

(12) United States Patent
Kawamoto et al.

(10) Patent No.: US 8,602,678 B2
(45) Date of Patent: Dec. 10, 2013

(54) JOINTING STRUCTURE OF VEHICLE TRAVELING PATH JOINTS HAVING EXPANSION FUNCTION AND METHOD OF MOUNTING ELASTIC MEMBER THEREIN

(75) Inventors: Takashi Kawamoto, Aichi (JP); Takafumi Matsuda, Aichi (JP); Masaaki Miyamoto, Aichi (JP); Hironori Sadakane, Aichi (JP); Katsunori Yokokawa, Tokyo (JP); Minoru Tsukahara, Tokyo (JP); Junichi Kawaura, Aichi (JP); Yuki Motoyama, Tokyo (JP)

(73) Assignees: Central Japan Railway Company, Aichi (JP); Abe Nikkokogyo Co., Ltd., Tokyo (JP); JR Central Consultants Company, Aichi (JP); Japan Transportation Consultants, Inc., Tokyo (JP)

( * ) Notice: Subject to any disclaimer, the term of this patent is extended or adjusted under 35 U.S.C. 154(b) by 0 days.

(21) Appl. No.: 13/413,931

(22) Filed: Mar. 7, 2012

(65) Prior Publication Data

US 2012/0237295 A1 Sep. 20, 2012

(30) Foreign Application Priority Data

Mar. 16, 2011 (JP) ..... 2011-57355

(51) Int. Cl.
*E01C 11/02* (2006.01)

(52) U.S. Cl.
USPC ..... 404/74; 404/47; 404/49; 52/393

(58) Field of Classification Search
CPC ..... E04F 15/14
USPC ..... 404/69, 70, 47–49, 68, 74; 52/393
See application file for complete search history.

(56) References Cited

U.S. PATENT DOCUMENTS

| | | | | | |
|---|---|---|---|---|---|
| 3,595,142 | A | * | 7/1971 | Via | 404/49 |
| 3,606,931 | A | * | 9/1971 | Karden | 173/93.5 |
| 3,722,379 | A | * | 3/1973 | Koester | 404/68 |
| 3,829,229 | A | * | 8/1974 | Britton et al. | 404/69 |
| 3,850,539 | A | * | 11/1974 | Bowman et al. | 404/69 |
| 3,881,835 | A | * | 5/1975 | Moerk et al. | 404/64 |

(Continued)

FOREIGN PATENT DOCUMENTS

| | | |
|---|---|---|
| JP | 09-059904 | 3/1997 |
| JP | 10-082002 | 3/1998 |
| JP | 2000-104204 | 4/2000 |
| JP | 2003-184006 | 7/2003 |

*Primary Examiner* — Raymond W Addie
(74) *Attorney, Agent, or Firm* — Pearne & Gordon LLP

(57) ABSTRACT

A jointing structure comprising multiple steps provided face to face at the coaxially built traveling path ends with an expansion gap between, multiple elastic members respectively mounted inside the multiple steps, and a joint block mounted on the multiple elastic members across the expansion gap. Multiple supporting blocks and one or more than one intermediate joint block are mounted inside the multiple steps with the joint block between. The multiple supporting blocks, the joint block and the one or more than one intermediate joint block are of concrete. The elastic members are joined together across the expansion gap. The elastic member on one side is fixed to the inside of the step on one side and then subjected to deformation toward the bridge girder axis, and thereafter, the elastic member on the other side is fixed to the inside of the step on the other side.

20 Claims, 8 Drawing Sheets

(56) References Cited

U.S. PATENT DOCUMENTS

| | | | | | |
|---|---|---|---|---|---|
| 3,992,121 | A * | 11/1976 | Geiger | 404/47 |
| 4,080,086 | A * | 3/1978 | Watson | 404/69 |
| 4,084,912 | A * | 4/1978 | Pyle et al. | 404/74 |
| 4,131,382 | A * | 12/1978 | Hymo | 404/69 |
| 4,260,279 | A * | 4/1981 | Hein | 404/74 |
| 4,279,533 | A * | 7/1981 | Peterson et al. | 404/68 |
| 4,833,851 | A * | 5/1989 | Ohmatsu | 52/396.05 |
| 5,024,554 | A * | 6/1991 | Benneyworth et al. | 404/74 |
| 5,028,168 | A * | 7/1991 | Conversy | 404/68 |
| 5,607,253 | A * | 3/1997 | Almstrom | 404/47 |
| 5,628,857 | A * | 5/1997 | Baerveldt | 156/244.25 |
| 6,039,503 | A * | 3/2000 | Cathey | 404/67 |
| 6,532,708 | B1 * | 3/2003 | Baerveldt | 52/396.05 |
| 6,619,879 | B1 * | 9/2003 | Scuero | 404/74 |
| 6,751,919 | B2 * | 6/2004 | Calixto | 52/573.1 |

* cited by examiner

[IN TIME OF ORDINARY TEMPERATURES]

[FOR EXPANSION GAP NARROWER THAN THAT IN TIME OF ORDINARY TEMPERATURES]

[FOR EXPANSION GAP WIDER THAN THAT IN TIME OF ORDINARY TEMPERATURES]

【IN OCCURRENCE OF EXPANSION GAP WIDER THAN THAT IN TIME OF ORDINARY TEMPERATURES】

【IN OCCURRENCE OF EXPANSION GAP NARROWER THAN THAT IN TIME OF ORDINARY TEMPERATURES】

[IN TIME OF ORDINARY TEMPERATURES]

[FOR EXPANSION GAP NARROWER THAN THAT IN TIME OF ORDINARY TEMPERATURES]

[FOR EXPANSION GAP WIDER THAN THAT IN TIME OF ORDINARY TEMPERATURES]

JOINTING STRUCTURE OF VEHICLE TRAVELING PATH JOINTS HAVING EXPANSION FUNCTION AND METHOD OF MOUNTING ELASTIC MEMBER THEREIN

BACKGROUND OF THE INVENTION

1. Field of the Invention

This invention relates to a jointing structure in vehicle traveling path joints and the like having an expansion function and also to a method of mounting an elastic member therein, and is useful in applications mainly to vehicle traveling path joints in new transit systems, monorails and the like and besides, to road bed plate joints in road bridges, footbridges and the like.

2. Description of the Related Arts

One well-known urban traffic means is a new transit system which makes use of rubber tires to provide traveling on an exclusive vehicle traveling path using a motor, with power fed via a feeder line laid parallel to the traveling path.

This type of traffic means is such that a vehicle traveling path is built continuously in a belt-like form with concrete on a bridge girder and has an expansion gap in the same position as a bridge girder joint in order to absorb bridge girder expansion or contraction caused by temperature changes or the like.

With this type of traffic means, a traveling path joint is especially fitted with a rubber or steel expansion joint to prevent the occurrence of tire fallen-in, stuck-in and/or like situations so that the increased riding quality as well as the maintainability of in-traveling safety are provided.

Regarding an expansion joint applied to an expansion gap and having an elastic function with respect to the bridge girder expansion or contraction, the patent document 1, for instance, describes an expansion joint having a top-plate reinforcing material laid over the expansion gap, side-plate reinforcing materials respectively fixed to the traveling path ends, and chloroprene rubber or the like adapted to join the top-plate reinforcing material and both the side-plate reinforcing materials together.

Patent Documents on The Related Arts

[Patent document 1] Japanese Laid-open Patent Publication No. Hei.9-59904

[Patent document 2] Japanese Laid-open Patent Publication No. Hei.10-82002

[Patent document 3] Japanese Laid-open Patent Publication No. 2000-104204

[Patent document 4] Japanese Laid-open Patent Publication No. 2003-184006

However, the rubber expansion joint has encountered with such problem that it is difficult to ensure slip resistance to rubber tires and/or to pass judgement on the time for replacement because of a lack of its durability required for a tire-supporting surface.

Meanwhile, the steel expansion joint has encountered with, in addition to the problem about the slip resistance to the rubber tires, such problem that it is difficult to be given difference-in-level management by reason that a difference in level is liable to occur between the expansion joint and the traveling path, and consequently, would be considered to have a great effect on the tires and the like unless it is managed in several millimeter units.

The steel expansion joint has further involved the problem of in-traveling safety by reason that it may well be that tire punctures will occur in course of traveling due to cracks resulting from metal fatigues of mounting bolts or like components.

With both the above types of expansion joints, there has been still some fear of the tire fall-in and/or stuck-in situations occurring in cases of bridge girder portions in which a greater extent of expansion or contraction caused by temperature changes is found and/or of small-sized vehicles whose tires are small in diameter, in which case, it has been likely to lead to a reduction in riding quality.

In conventional expansion joint applications, vertical differences in level (which are such that the bridge girders are displaced in their joints on different levels) and/or lateral displacements (which are such that the bridge girders are displaced in their joints perpendicularly to a bridge girder axis) and besides, kinked joints (which are such that the bridge girders are kinked in their joints laterally) and the like when occurred in the joints of the bridge girders due to an earthquake or the like could be left as they were even after the earthquake, or could lead to the complete collapse of the bridge girders under certain circumstances. Accordingly, for the passage of emergency vehicles and the like, it has been necessary to take such emergency measures as to cover the bridge girder joints with steel sheets or the like.

SUMMARY OF THE INVENTION

It is an object of the present invention to provide a jointing structure in vehicle traveling path joints and the like having an expansion function, more specifically, a jointing structure which is adaptable for applications of various tire configurations different in tire diameter and the like, ensures high slip resistance to tires, permits less occurrence of tire fallen-in and/or stuck-in situations and is easy to be given maintenance, and also to provide a method of mounting an elastic member therein.

A jointing structure in vehicle traveling path joints and the like having an expansion function according to the present invention comprises more than one step provided face to face at the coaxially built traveling path ends with an expansion gap between, more than one elastic member respectively mounted inside the above more than one step, and a joint block mounted on the above more than one elastic member across the above expansion gap.

The present invention is to be adapted to prevent, by blocking up the expansion gap in a bridge girder joint with the joint block while permitting an expansion gap function to be maintained, the occurrence of tire fall-in and/or stuck-in situations for the achievement of smooth and safe vehicle traveling (see FIG. 2), and is thus useful in applications mainly to vehicle traveling path joints in new transit systems, monorails and the like, i.e., joints of vehicle traveling paths respectively built on bridge girders as an integral part thereof, and besides, to road bed plate joints in road bridges, foot bridges and the like.

According to the present invention, it will be appreciated that even in the occurrence of any displacement such as the vertical differences in level and/or the lateral displacements and besides, the kinked joints in the joints of the bridge girders especially due to the earthquake or the like, the joint block may be conditioned to be always in the center of the expansion gap thanks to elastic member deformation for the elimination and/or relief of the differences in level and/or the lateral displacements and the like, resulting in the achievement of smooth vehicle traveling without the need for any emergency measures involving the use of the steel sheets or the like.

It will be appreciated also that the joint block is placed across the expansion gap, and thus, the adequate management of accuracy of each member if given may be adapted to prevent the differences in level from occurring in any joint portion between the joint block and the traveling path.

It is noted that the use of a joint block made of the same concrete as that of the traveling path may be adapted to provide more substantially increased slip resistance to the tires, as compared with the rubber or steel expansion joint. It is noted also especially that a high-strength fiber-reinforced concrete joint block is as highly durable as hardly worn away, and is thus considered to be suitably applicable to the joint block for use in the present invention.

The elastic members are desirably of a material that is hard to be deformed vertically and vice verse easy to be deformed horizontally in a soft manner. The present invention employs elastic members mainly consisting of laminated rubber. Further, the elastic members and the joint block are fitted to each other detachably by bolting or the like and consequently, may be easily given the maintenance thereof as well.

It would be possible also to mount supporting blocks inside the steps with the joint block between in order to protect the traveling path ends with the thus mounted supporting blocks so as to prevent the traveling path ends from being damaged due to tire impingement and/or impact responses and the like at the time of passage of the vehicles (see FIG. 2). The supporting blocks may be of concrete or high-strength fiber-reinforced concrete like the traveling path and the joint block.

In this case, the supporting blocks are fitted detachably to the intra-step traveling path side walls in close contact therewith with mounting bolts or the like to form a continuously extending traveling path surface and consequently, may be easily restored to normal by replacement even if damaged.

It would be possible also to mount, in a manner that one or more than one intermediate joint block is mounted inside the steps with the joint block between, more than one joint block in the traveling path joint in order to decentralize the expansion gap in the traveling path joint into more than one expansion gap to make the size of each individual expansion gap smaller, so that the occurrence of tire fall-in and/or stuck-in situations may be prevented more surely for the achievement of the increased driving quality (see FIG. 6). For instance, the size of the expansion gap in the traveling path joint may be reduced down to one fourth by mounting the intermediate joint blocks one by one to the opposite sides of the intra-step joint block.

Furthermore, the use of a joint block, supporting blocks and intermediate joint blocks that are of concrete of the same quality as that of the traveling path or of high-strength fiber-reinforced concrete may be adapted to lead to such advantage that the difference in level will be hard to occur in any joint portion between the blocks because of the substantially same-mannered developments of wear on each member, so that the difference-in-level management of the joints becomes more facilitated.

By reason of a structure which is such that members such as metal members and rubber members are not exposed to the traveling path joints, especially, to the traveling path surface, it is possible not only to eliminate the problems such as developments of rust on these members and degradations thereof but also to prevent scattering of these members for the achievement of the increased in-traveling safety for vehicles.

It would be possible also to provide, obliquely with respect to the axial direction of the traveling path, the expansion gap in a joint portion between each of the traveling path ends and the joint block in order to prevent the occurrence of tire fall-in and/or stuck-in situations particularly in cases of small-sized vehicles whose tires are small in diameter, while ensuring a required expansion gap (see FIG. 7).

It is noted that it is possible to prevent the occurrence of tire fall-in and/or stuck-in situations in cases of small-sized vehicles whose tires are small in diameter, while ensuring a required expansion gap, also by providing, obliquely with respect to the axial direction of the traveling path, the expansion gap in a joint portion between the joint block and each of the supporting blocks, that in a joint portion between the joint block and each of the intermediate joint blocks and that in a joint portion between each of the intermediate joint blocks and each of the supporting blocks.

In a method of mounting an elastic member in vehicle traveling path joints and the like having an expansion function and each composed of more than one step provided face to face at the coaxially built traveling path ends with an expansion gap between, more than one elastic member respectively mounted inside the above more than one step, and a joint block mounted on the above more than one elastic member across the above expansion gap, a method of mounting an elastic member in vehicle traveling path joints and the like having an expansion function comprises the steps of joining the above elastic members together across the above expansion gap and fixing the elastic member on one side to the step on one side, then subjecting the thus fixed elastic member to deformation toward the bridge girder axis, and thereafter fixing the elastic member on the other side to the step on the other side.

It is generally known in the bridge girders of RC construction, PC construction and/or steel-frame construction that the width of the expansion gap in the joint between the bridge girders varies with seasonal changes and temperature changes in a day as well. It is known also that the bridge girders of RC construction and/or PC construction easily produce fluctuations of the expansion gap width even with concrete drying shrinkage and/or creep effects In designing the elastic member under such environments, it is the most economical as the elastic member that it is designed so as to permit no deformation to occur in the elastic member too at the time when the drying shrinkage and/or any shrinkage resulting from the creep has come to be convergent and besides, a bridge girder length varying with temperature has reached a median (i.e., a bridge girder length in time of ordinary temperatures) between a bridge girder length in time of high temperatures and that in time of low temperatures.

For that reason, the elastic member may be mounted without being affected by the seasons and/or the periods of time in a day and besides, by the bridge girder ages. Desirably, the elastic member should be so mounted that it will be conditioned to be free of any deformation therein at the time when the drying shrinkage and/or the creep of the bridge girders has come to be convergent and besides, the bridge girder length in time of ordinary temperatures has been reached.

In attempting to make setting of the expansion gap in conventional expansion joint applications in order to provide an expansion gap that meets a temperature at the time of mounting and/or the bridge girder ages, expansion gap adjustments have been made by taking steps of predicting a temperature at the time of mounting, then preliminarily adjusting the expansion gap width in a factory and the like, then temporarily fixing the expansion gap with an exclusive fixing jig or the like, and finally releasing the expansion gap from its temporarily fixed state after mounting in a construction site.

However, by reason that the temperature at the time of mounting is of a predicted value, it is necessary to make expansion gap readjustments in accordance with an actual temperature at the time of mounting in cases where the predicted value is much different from the actual temperature at the time of mounting, resulting in the need for troublesome mounting.

According to the present invention, it will be appreciated that it is possible to easily mount the elastic member without being affected in any way by the seasons and/or the periods of time and besides, by the bridge girder ages and the like so that it will be conditioned to be free of any deformation therein or in normal position whenever the bridge girder length in time of ordinary temperatures has been reached.

In this case, it would be possible also to set the expansion gap width in time of ordinary temperatures at a median between the greatest expansion gap width and the smallest expansion gap width in order to minimize the expansion gap of the greatest width and also to avoid bringing the bridge girder ends into contact with each other even if the expansion gap comes to be narrowed.

It is noted that the elastic members may be easily joined together by mounting, across the expansion gap over the elastic members, the joint block or a backing plate used to mount the joint block (see FIG. 9A). It is noted also that the elastic members may be easily subjected to deformation by pressing them toward the bridge girder axis using an oil hydraulic jack or the like (see FIGS. 9B and 9C).

According to the present invention, it will be appreciated that it is possible to prevent, by decentralizing the expansion gap in the joint between the bridge girders into more than one smaller-width expansion gap with the joint block while permitting the expansion gap function to be maintained, the occurrence of tire fall-in and/or stuck-in situations for the achievement of smooth vehicle traveling. It will be appreciated also that the components such as the joint block are fitted in detachable fashion by bolting or the like and consequently, may be easily given the maintenance thereof.

It will appreciated also that the present invention is adaptable for applications of various tire configurations different in tire diameter, ensures high slip resistance to the tires, permits less occurrence of tire fall-in and/or stuck-in situations, and is easy to be given the maintenance.

BRIEF DESCRIPTION OF THE DRAWINGS

Other features and advantages of the invention will become apparent from the following description taken in connection with the accompanying drawings in which:

FIG. 4A is a plan view showing the traveling path ends in the traveling path joints and the like;

FIG. 4B is a sectional view, taken on line D-D in FIG. 4A, showing the traveling path ends in the traveling path joints and the like;

FIG. 5A is a sectional view showing the behavior of an expansion gap in the traveling path joints and the like in association with bridge girder expansion or contraction caused by temperature changes or the like;

FIG. 5B is a sectional view showing the behavior of an expansion gap in the traveling path joints and the like resulting from bridge girder expansion caused by temperature changes or the like;

FIG. 5C is a sectional view showing the behavior of an expansion gap in the traveling path joints and the like resulting from bridge girder contraction caused by temperature changes or the like;

DETAILED DESCRIPTION OF THE PREFERRED EMBODIMENTS

Figure 1A:
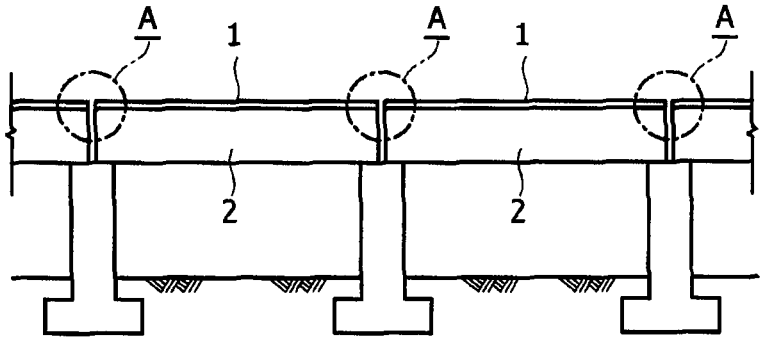
FIG. 1A is a fragmentary side view showing the track of an urban transit system.
Figure 1B:
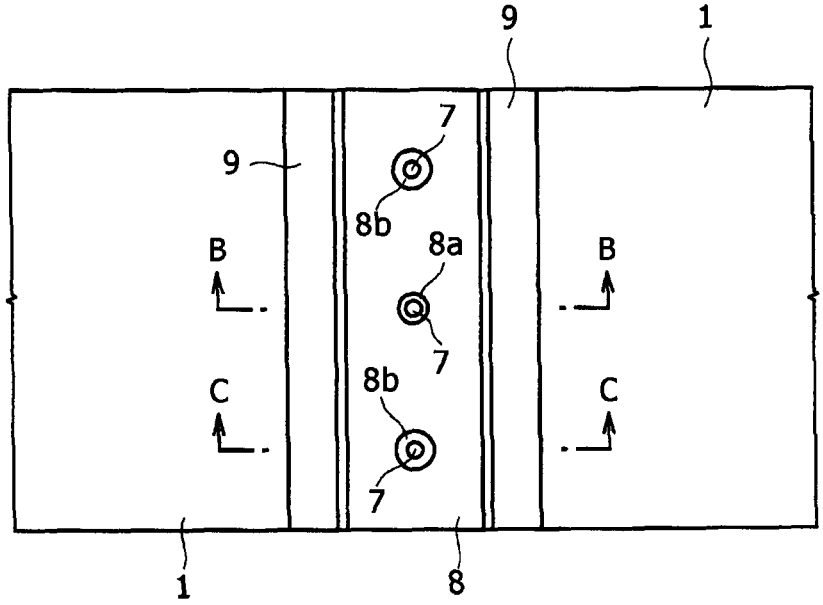
FIG. 1B is an enlarged plan view showing a portion A in FIG. 1A.
Figure 2A:
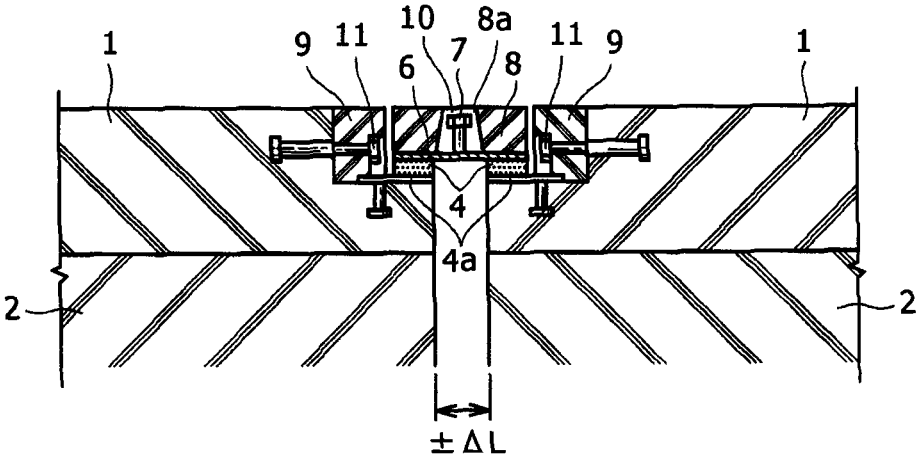
FIG. 2A is a sectional view, taken on line B-B in FIG. 1B, showing one embodiment of a jointing structure in vehicle traveling path joints and the like having an expansion function according to the present invention.
Figure 2B:
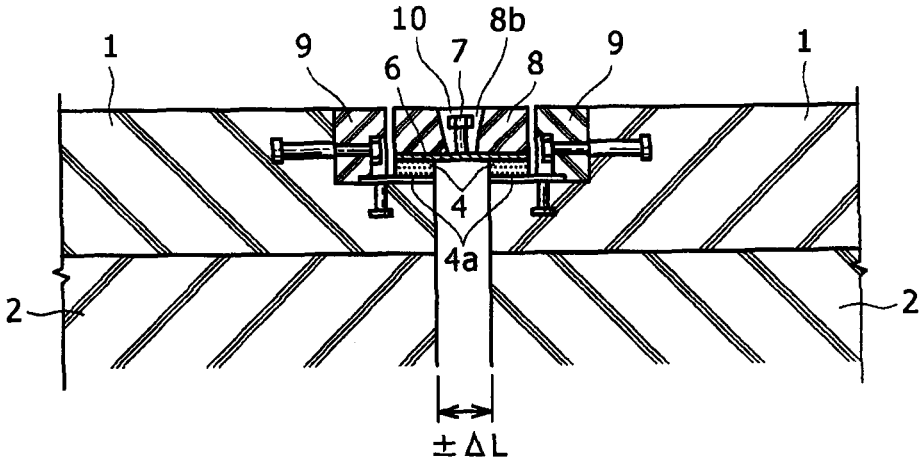
FIG. 2B is a sectional view, taken on line C-C in FIG. 1B, showing one embodiment of a jointing structure in vehicle traveling path joints and the like having an expansion function according to the present invention.

FIGS. 1A to 5C respectively show one embodiment of the present invention wherein a bridge girder 2 serves to support a traveling path 1 adapted for vehicle traveling. The traveling path 1 is of concrete and extends continuously in a belt-like form on the bridge girder 2 in the axial direction thereof. The traveling path 1 is formed as an integral part of the bridge girder 2 and has an upper end surface in a flat form.

The bridge girder 2 is formed with manufactured girders such as RC girders, PC girders and steel girders. A joint between the bridge girders 2, 2 has an expansion gap $\pm\Delta L$ extending perpendicularly to the axis of the bridge girder 2 in order to absorb the expansion or contraction of the bridge girders 2 caused by temperature changes or the like.

Further, there is provided between the traveling paths 1, 1 the same joint as the joint between the bridge girders 2, 2 in the direction perpendicular to the axis of the traveling path 1 in conformity with the bridge girder joint, and the joint between the traveling paths 1, 1 also has the same expansion gap $\pm\Delta L$ as the expansion gap $\pm\Delta L$ in the joint between the bridge girders 2, 2 in the direction perpendicular to the axis of the traveling path 1.

The traveling paths 1, 1 have, at the ends thereof in the traveling path joint, steps 3, 3 facing each other with the expansion gap $\pm\Delta L$ between, and laminated rubbers 4, 4 are respectively mounted inside the steps 3, 3 with the expansion gap $\pm\Delta L$ between.

The laminated rubber 4 is formed by piling up a thin rubber layer and a steel sheet alternately in multiple layers to place the rubber layers under restraint so that it will be hard to be deformed vertically and vice verse easy to be deformed horizontally in a soft manner.

Further, the laminated rubber 4 is formed in the shape of a rectangular parallelepiped lengthwise in the direction perpendicular to the axis of the traveling path 1 and has at a lower end thereof a base plate 4*a*. And, the laminated rubber 4 is fixedly placed in detachable fashion on a bottom 3*a* of each of the step 3, 3 by fastening the base plate 4*a* to the bottom 3*a* with more than one anchor bolt 5.

Further, a backing plate 6 is mounted on the laminated rubbers 4, 4 across the expansion gap ±ΔL, so that the laminated rubbers 4, 4 are integrally joined together through the thus mounted backing plate 6. Thus, the laminated rubbers 4, 4 are supposed to get deformed as a unit, following the expansion or contraction or the like of the bridge girders 2 as shown in FIGS. 5A, 5B and 5C.

Figure 5A:
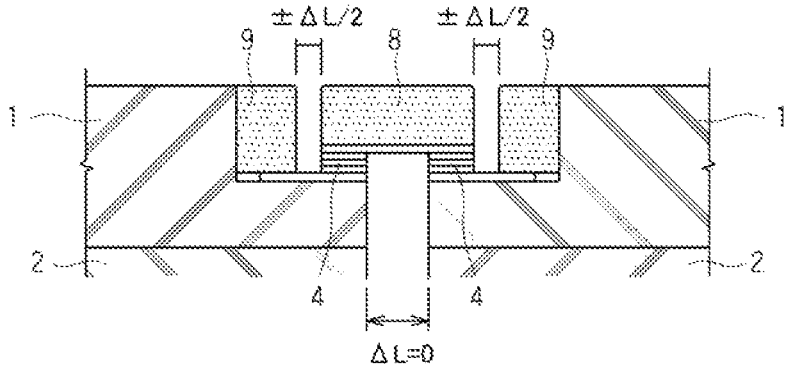

FIG. 5A shows that the laminated rubbers 4 are being free of any deformation therein (or in normal position) as the result of no development of the expansion or contraction caused by temperature changes or the like on any bridge girder 2, wherein the backing plate 6 is fixedly placed on the laminated rubbers 4, 4. From the seasonal point of view, such deformation-free state is considered to be that found in the spring and/or autumn time with the smallest difference in temperature.

Figure 5B:
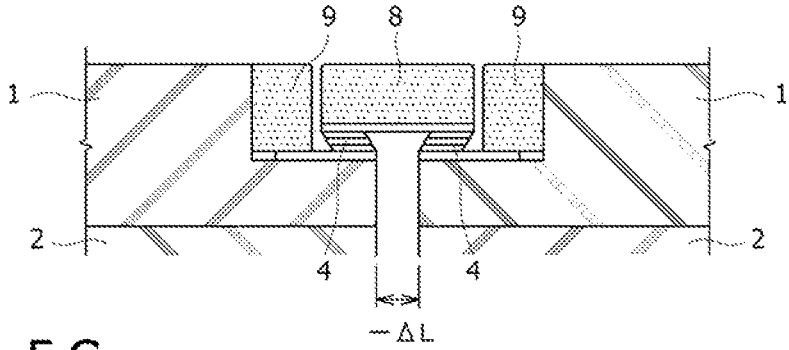
Figure 5C:
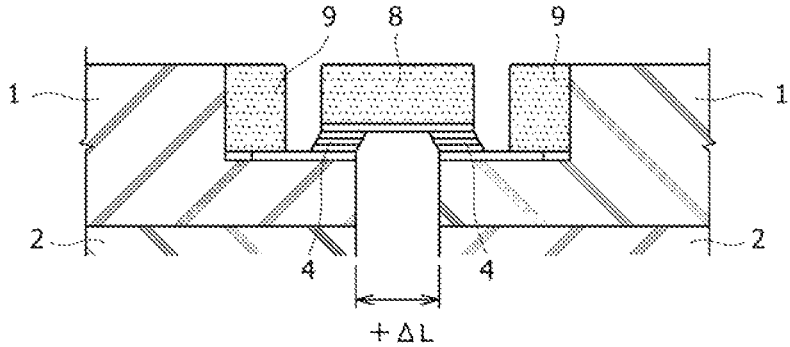

FIG. 5B shows that the laminated rubbers 4 are being deformed such as to absorb the expansion of the bridge girders 2 caused by the temperature changes as the result of the narrowed expansion gap ±ΔL due to the above bridge girder expansion, and such deformed state is considered to be that found in the summer time from the seasonal point of view. Meanwhile, FIG. 5C shows that the laminated rubbers 4 are being deformed such as to absorb the contraction of the bridge girders 2 caused by the temperature changes as the result of the widened expansion gap ±ΔL due to the above bridge girder contraction, and such deformed state is considered to be that found in the winter time from the seasonal point of view.

Figure 3A:
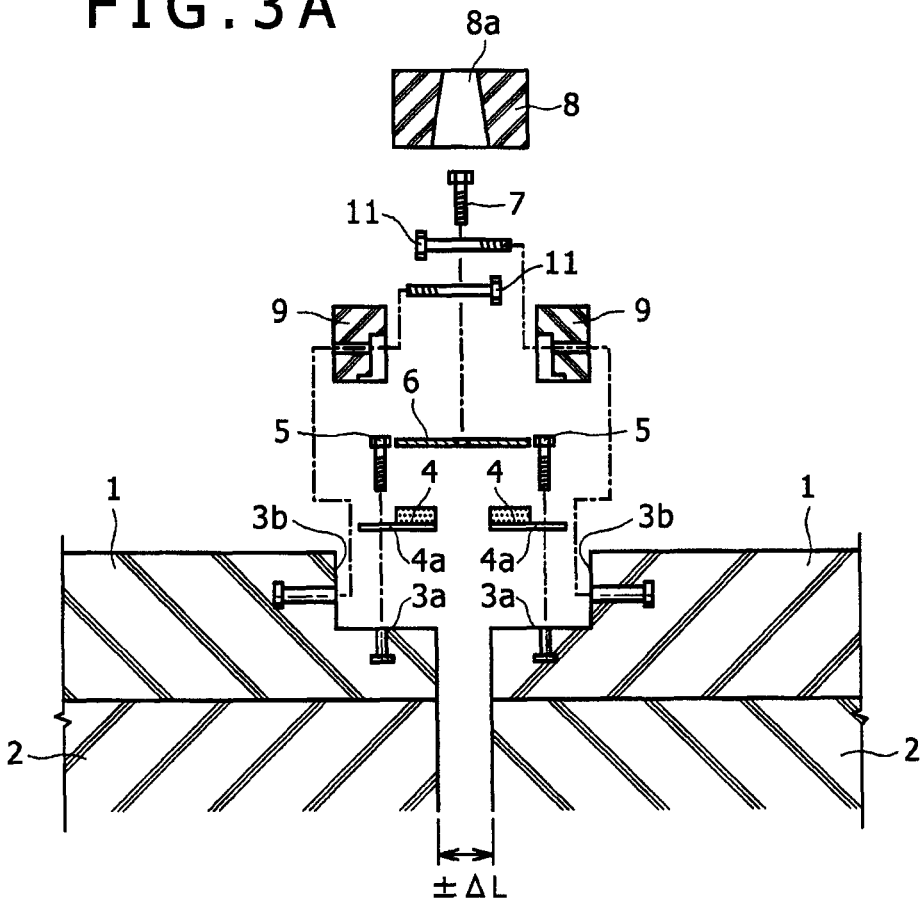
FIG. 3A is an exploded sectional view showing one embodiment of a jointing structure in vehicle traveling path joints and the like having an expansion function according to the present invention.
Figure 3B:
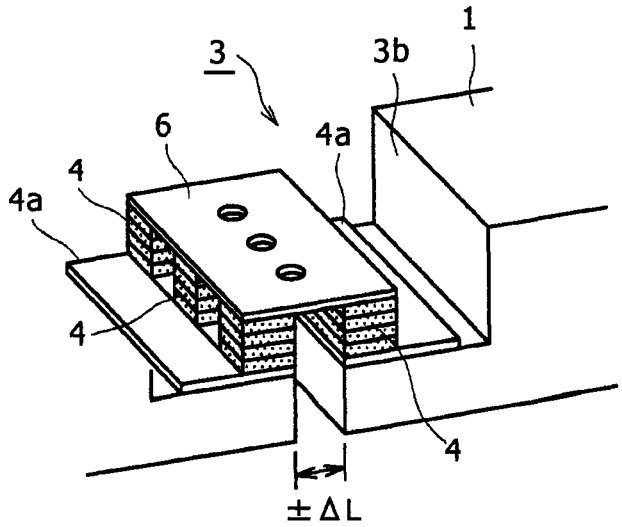
FIG. 3B is a perspective view showing another embodiment of the jointing structure in the vehicle traveling path joints and the like having the expansion function according to the present invention.
Figure 4A:
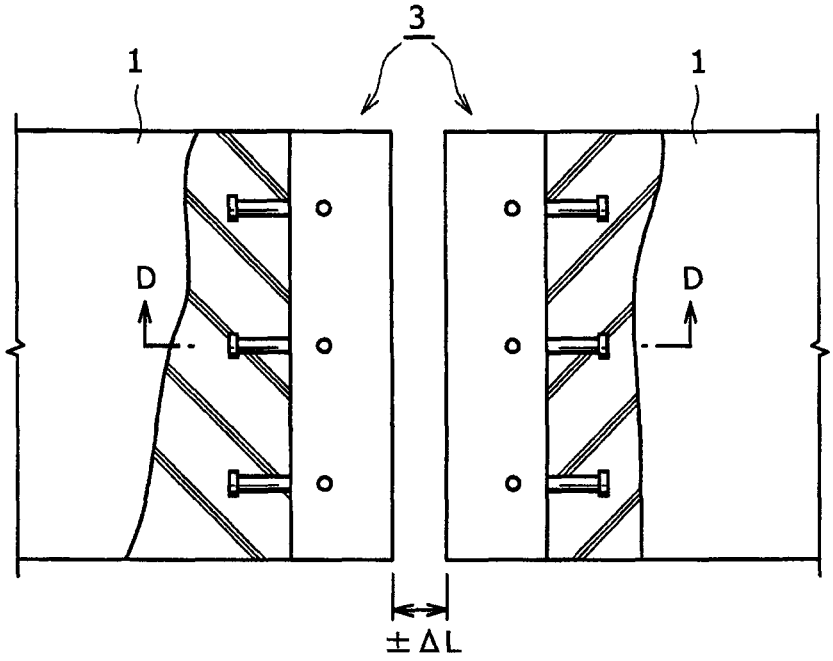
Figure 4B:
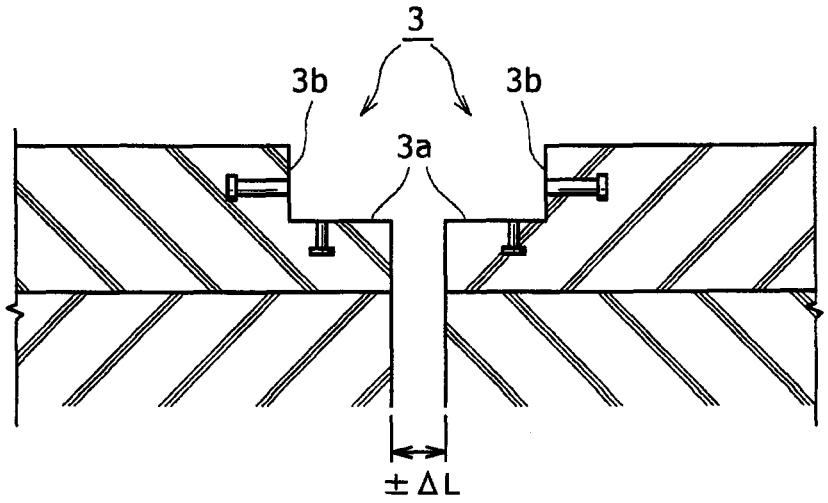

It is noted that the laminated rubber 4 may be also in a square or circular-in-plan form, in which case, such laminated rubber may be mounted to the bottom 3*a* in each step 3 in such a manner as to be placed in more than one position. Referring to FIG. 3B, there is shown one laminated rubber arrangement which is such that three pieces of square-in-plan laminated rubbers 4 are spaced at fixed intervals in the direction perpendicular to the axis of the bridge girder 2.

The backing plate 6 is formed in the shape of a rectangular plate lengthwise in the direction perpendicular to the axis of the traveling path 1, and is attached with, respectively in the center and at the opposite ends in the direction of the lengthwise sides thereof, projecting anchor bolts 7.

Further, a joint block 8 is mounted on the backing plate 6, and supporting blocks 9, 9 are respectively mounted to the opposite sides of the joint block 8 with this joint block between.

Both the joint block 8 and each supporting block 9 are of the same concrete as the traveling path 1 and in the shape of a rectangular parallelepiped lengthwise in the direction perpendicular to the axis of the traveling path 1, an upper end surface of the joint block 8 and that of each supporting block 9 being made flush with the upper end surface of the traveling path 1.

The joint block 8 has, respectively in the center and at the opposite ends in the direction of the lengthwise sides thereof, loose holes 8*a*, 8*b*, into which the anchor bolts 7 are respectively inserted.

Further, the loose holes 8*a*, 8*b* are respectively charged with a hardening material 10 such as mortar. Thus, the joint block 8 is fixedly placed on the backing plate 6.

It is noted that the loose hole 8*a* is formed in the shape of a circular cone having a downwardly gradually increasing inner diameter, and the loose hole 8*b* at each of the opposite ends of the loose hole 8*a* is formed in the shape of a circular cone having an upwardly gradually increasing inner diameter.

By reason that the loose holes 8*a*, 8*b* respectively take the shapes as described the above, the joint block 8 is firmly fixed in three positions to the upside of the backing plate 6. Further, the removal of the joint block 8 from the upside of the backing plate 6, if required, can be made in such a relatively easy manner as to only crush the hardening material 10 in the loose hole 8*b*.

Each supporting block 9 is fixedly fitted in detachable fashion to the side wall 3*b* of each step 3 in close contact therewith with more than one mounting bolt 11.

It is noted that it would be possible also to mount the joint block 8 directly on the laminated rubbers 4, 4 with bolts, adhesives or the like in order to eliminate the need for the backing plate 6 so that a simplified structure may be provided.

With the above arrangements, it will be appreciated that the expansion gap ±ΔL in the joint between the traveling paths 1, 1 is blocked up with the joint block 8 so that an expansion gap ±ΔL/2 smaller in width than the expansion gap ±ΔL is provided between the joint block 8 and each of the supporting blocks 9 at the opposite sides thereof, and this allows the occurrence of tire fallen-in and/or stuck-in situations in vehicles to be substantially reduced, resulting in the achievement of smooth vehicle traveling on the traveling path 1. It will be appreciated also that the absorption of the expansion or contraction of the bridge girders 2 caused by the temperature changes or the like may be achieved as well thanks to the deformation of the laminated rubbers 4, 4.

It is noted that each expansion gap ±ΔL/2 in a joint portion between the joint block 8 and each of the supporting blocks 9 at the opposite sides thereof will be made uniform by adjusting the shear modulus of the laminated rubber 4.

It will be appreciated also that the laminated rubbers 4, the joint block 8 and the supporting blocks 9 are all fitted in detachable fashion so that the maintenance of the joints may be facilitated.

Figure 6:
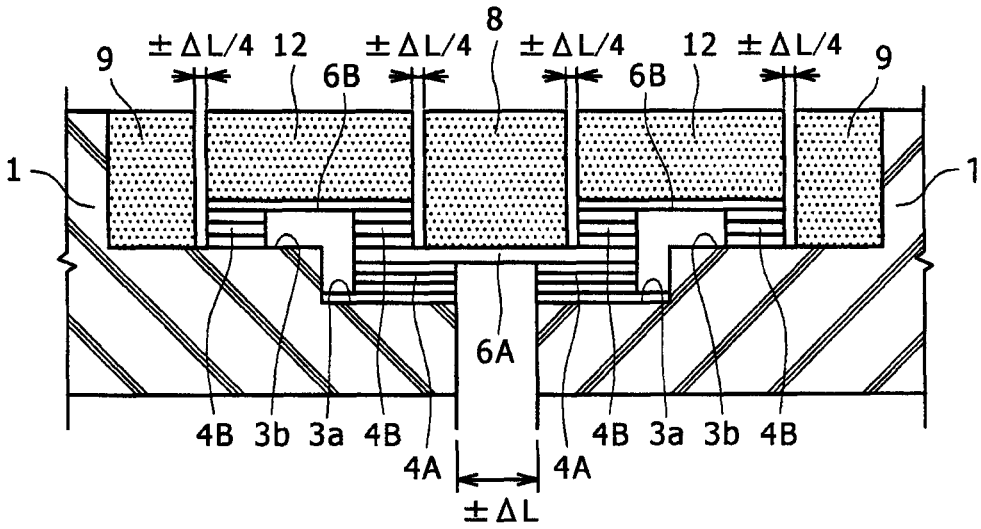
FIG. 6 is a sectional view showing a further embodiment of the jointing structure in the vehicle traveling path joints and the like having the expansion function according to the present invention.

FIG. 6 shows another embodiment of the present invention which is especially such that the bottom in each step 3 is in the form of a two-stepped bottom composed of a bottom 3*a* and a bottom 3*b* extending in the axial direction of a traveling path 1. In this embodiment, first-stage laminated rubbers 4A, 4A are respectively mounted on the first-stage bottoms 3*a*, 3*a*.

Further, a first-stage backing plate 6A is mounted on the laminated rubbers 4A, 4A across an expansion gap ±ΔL, and on the first-stage backing plate 6A is mounted a joint block 8.

Furthermore, second-stage laminated rubbers 4B, 4B are respectively mounted on both the second-stage bottom 3*b* and the first-stage backing plate 6A, and on the second-stage laminated rubbers 4B, 4B is mounted a second-stage backing plate 6B across a space between the laminated rubbers 4B, 4B.

Moreover, an intermediate joint block 12 is mounted between the joint block 8 and each of the supporting blocks 9, wherein it is fixedly placed on the second-stage backing plate 6B. The upper end surface of each supporting block 9, that of the joint block 8 and that of each intermediate joint block 12 are made flush with the upper end surface of the traveling path 1.

With the above arrangements, it will be appreciated that the expansion gap ±ΔL in the joint between the traveling paths 1, 1 is blocked up with the joint block 8 so that an expansion gap ±ΔL/4 smaller in width than the expansion gap ±ΔL is provided between the joint block 8 and each of the intermediate joint blocks 12 at the opposite sides thereof and between each of the intermediate joint blocks 12 and each of the supporting blocks 9, and this allows the occurrence of tire fallen-in and/or stuck-in situations in vehicles to be substantially reduced, resulting in the achievement of smooth vehicle traveling on the traveling path 1. It will be appreciated also that the absorption of the expansion or contraction of the bridge girders 2 caused by the temperature changes or the like may be easily achieved as well thanks to the deformation of the laminated rubbers 4, 4.

It will be appreciated also that the laminated rubbers 4B, 4B, the joint block 8, the intermediate joint blocks 12 and the supporting blocks 9 are all fitted in detachable fashion so that the maintenance of the joints may be facilitated.

It will be appreciated also that each expansion gap ±ΔL/4 in a joint portion between the joint block 8 and each of the intermediate joint blocks 12 at the opposite sides thereof and each expansion gap ±ΔL/4 in a joint portion between each of the intermediate joint blocks 12 and each of the supporting blocks 9 in the case of the embodiment shown in FIG. 6 can be made uniform by adjusting the shear modulus of the laminated rubber 4.

Figure 7:
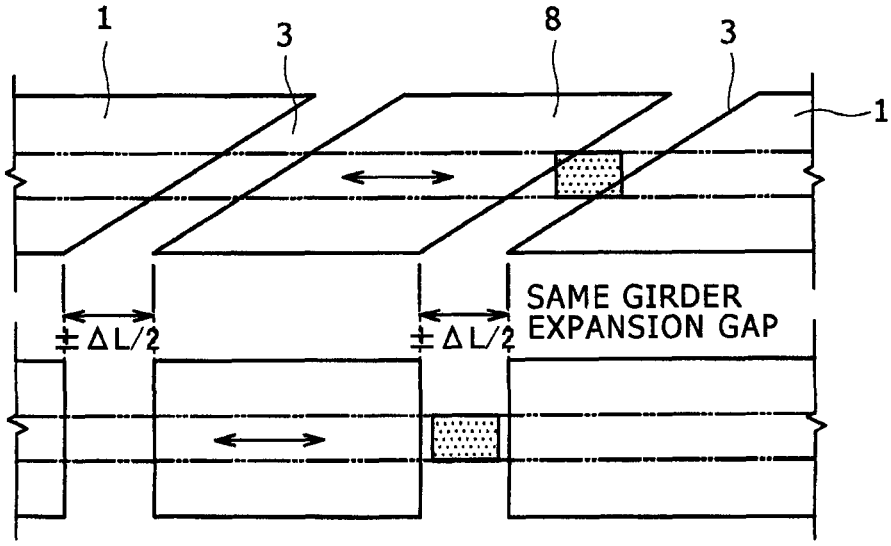
FIG. 7 is a plan view showing a still further embodiment of the jointing structure in the vehicle traveling path joints and the like having the expansion function according to the present invention.

FIG. 7 shows a further embodiment of the present invention which is especially such that joint portions between a joint block 8 and each of traveling path steps 3 at the opposite sides thereof respectively have mutually parallel expansion gaps ±ΔL/2 extending obliquely with respect to the axial direction of a traveling path 1, wherein the joint block 8 is in a parallelogrammic-in-plan form whose two sides respectively facing the expansion gaps ±ΔL/2 are assumed to be oblique sides.

Other arrangements are substantially the same as the embodiment having been previously described with reference to FIGS. 1A to 5C. According to the embodiment in FIG. 7, it will be appreciated that the occurrence of tire fall-in and/or stuck-in situations particularly in cases of small-sized vehicles whose tires are small in diameter may be reduced.

Figure 8A:
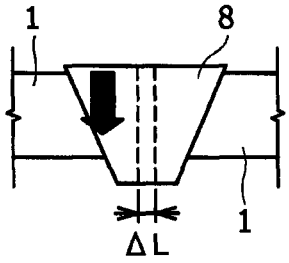
FIG. 8A is a plan view showing a still further embodiment of the jointing structure in the vehicle traveling path joints and the like having the expansion function according to the present invention.
Figure 8B:
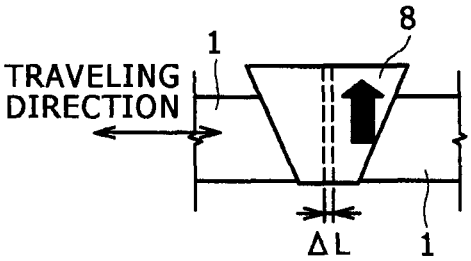
FIG. 8B is a plan view showing a still further embodiment of the jointing structure in the vehicle traveling path joints and the like having the expansion function according to the present invention.

FIGS. 8A and 8B respectively show a still further embodiment of the present invention which is especially such that joint portions between a joint block 8 and each of supporting blocks 9 at the opposite sides thereof respectively have symmetrical expansion gaps ±ΔL/2 extending obliquely with respect to the axial direction of a traveling path 1, wherein the joint block 8 is in a trapezoidal-in-plan form whose two sides respectively facing the expansion gaps are assumed to be oblique sides.

With the embodiment shown, the laminated rubber is supposed to be placed with no deformation developed therein (or in normal position) at the time when the expansion gap ±ΔL between the bridge girders 2, 2 reaches its maximum due to the contraction of the bridge girders 2 caused by the temperature changes. Other arrangements are substantially the same as the embodiment having been previously described with reference to FIGS. 1A to 5C.

In such arrangements, shifting of the joint block 8 in the direction perpendicular to the axis of the traveling path 1 is applied to meet the fluctuations of the expansion gap ±ΔL with the expansion or contraction of the bridge girders 2.

As shown in FIG. 8A, in cases where the expansion gap ±ΔL comes to be widened due to the bridge girder contraction caused by the temperature changes so that the laminated rubber deformation occurs to absorb such bridge girder contraction, the joint block 8 shifts in the direction shown by an arrow in association with the above laminated rubber deformation.

As shown in FIG. 8B, in cases where the expansion gap ±ΔL comes to be narrowed due to the bridge girder expansion caused by the temperature changes so that the laminated rubber deformation occurs to absorb such bridge girder expansion, the joint block 8 shifts in the direction shown by an arrow in association with the above laminated rubber deformation.

Figure 9A:
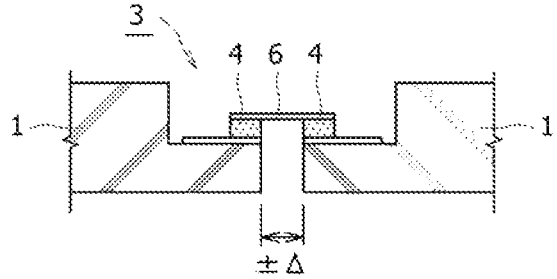
FIG. 9A is a sectional view showing a method of mounting an elastic member.
Figure 9B:
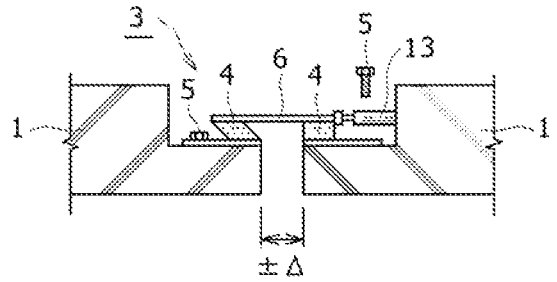
FIG. 9B is a sectional view showing a method of mounting an elastic member.
Figure 9C:
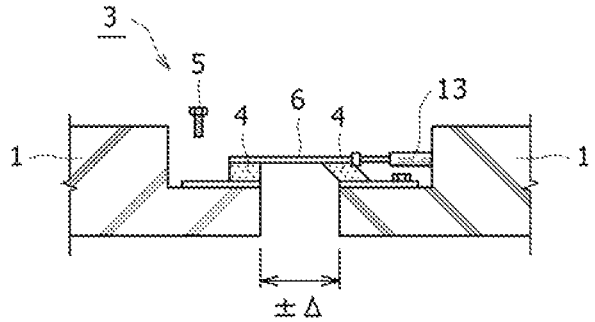
FIG. 9C is a sectional view showing a method of mounting an elastic member.

FIGS. 9A, 9B and 9C respectively show a method of mounting a laminated rubber for use in the embodiment having been previously described with reference to FIGS. 1A to 5C, and the procedure thereof will be described in the following.

(1) Firstly, the laminated rubbers 4 are joined together by placing the backing plate 6 across the expansion gap ±Δ over the laminated rubbers 4, 4 respectively mounted inside the steps 3 (see FIG. 9A). The backing plate 6 is joined to the laminated rubbers 4 by bolting or with adhesives or the like.

It is noted that it would be possible also to place the joint block directly across the expansion gap ±Δ over the laminated rubbers 4, 4 in order to eliminate the need for the backing plate 6.

(2) Subsequently, the laminated rubber 4 on one side is fixed to the bottom 3*a* in the step 3 with the anchor bolts 5. It is noted that the laminated rubber 4 on the fore side ahead of the expansion gap ±Δ is supposed to be fixed in cases where mounting of the laminated rubbers takes place in the summer time and the like considered that the bridge girder expansion will be ready to occur with increasing temperature (see FIG. 9B). Meanwhile, it is noted also that the laminated rubber 4 on this side of the expansion gap ±Δ is supposed to be fixed in cases where mounting of the laminated rubbers takes place in the winter time and the like considered that the bridge girder contraction will be ready to occur with decreasing temperature (see FIG. 9C). The anchor bolt 5 is fitted into a preliminarily embedded insert in the bottom 3*a*.

(3) Then, an oil hydraulic jack 13 is set inside the step 3 on one side. Then, the backing plate 6 is pressed out toward the bridge girder axis by bringing the oil hydraulic jack 3 into contact with the end of the backing plate 6. By so doing, the laminated rubber 4 fixed to the bottom 3*a* in the step 3 comes to be deformed toward the bridge girder axis.

(4) Then, after the deformation of the laminated rubber 4 reaches a predetermined amount, the laminated rubber 4 on the other side is fixed to the bottom 3*a* in the step 3 with the anchor bolts 5. Then, the jack 13 is removed, and it therefore follows that the laminated rubbers 4, 4 in such form as shown in FIG. 5B or 5C will be obtained. It is noted that the anchor bolt 5 is fitted into the preliminarily embedded insert in the bottom 3*a*.

It will be thus appreciated that the present invention is adaptable for applications of various tire configurations different in tire diameter, ensures high slip resistance to tires, permits less occurrence of tire fall-in and/or stuck-in situations and is easy to be given the maintenance.

While the preferred embodiments of the invention have been described, it is to be understood that changes and variations may be made without departing from the spirit or scope of the following claims.

What is claimed is:

1. A jointing structure of vehicle traveling path joints having an expansion function comprising:

a pair of steps formed face to face at the coaxially built traveling path ends with an expansion gap between;

a pair or pairs of elastic members mounted inside the pair of steps with said expansion gap between;

a backing plate mounted across said expansion gap over the pair or pairs of elastic members; and a joint block mounted on the backing plate;

wherein said pair or pairs of elastic members are mounted detachably inside said pair of steps, and said joint block is mounted detachably on said backing plate.

2. The jointing structure in the vehicle traveling path joints having the expansion function according to claim 1, wherein one or more than one intermediate joint block is mounted inside said pair of steps with said joint block between.

3. The jointing structure in the vehicle traveling path joints having the expansion function according to claim 2, wherein said joint block and said one or more than one intermediate joint block are of concrete or high-strength fiber-reinforced concrete.

4. The jointing structure in the vehicle traveling path joints having the expansion function according to claim 1, wherein more than one supporting block is mounted inside said pair of steps with said joint block between.

5. The jointing structure in the vehicle traveling path joints having the expansion function according to claim 4, wherein one or more than one intermediate joint block is mounted inside said pair of steps with said joint block between.

6. The jointing structure in the vehicle traveling path joints having the expansion function according to claim 5, wherein said more than one supporting block, said joint block and said one or more than one intermediate joint block are of concrete or high-strength fiber-reinforced concrete.

7. The jointing structure in the vehicle traveling path joints having the expansion function according to claim 1, wherein an expansion gap in a joint portion between each of said traveling path ends and said joint block is formed obliquely with respect to the axial direction of the traveling path.

8. The jointing structure in the vehicle traveling path joints having the expansion function according to claim 7, wherein one or more than one intermediate joint block is mounted inside said pair of steps with said joint block between, said joint block and said one or more than one intermediate joint block are of concrete or high-strength fiber-reinforced concrete.

9. The jointing structure in the vehicle traveling path joints having the expansion function according to claim 7, wherein more than one supporting block is mounted inside said pair of steps with said joint block between, one or more than one intermediate joint block is mounted inside said pair of steps with said joint block between.

10. The jointing structure in the vehicle traveling path joints having the expansion function according to claim 9, wherein said more than one supporting block, said joint block and said one or more than one intermediate joint block are of concrete or high-strength fiber-reinforced concrete.

11. In a method of mounting an elastic member of vehicle traveling path joints having an expansion function and each composed of a pair of steps formed face to face at the coaxially built traveling path ends with an expansion gap between; a pair or pairs of elastic members mounted inside the pair of steps with said expansion gap between; a backing plate mounted across said expansion gap over the pair or pairs of elastic members; and a joint block mounted on the backing plate, a method of mounting an elastic member of vehicle traveling path joints having an expansion function, comprising the steps of:

joining said pair or pairs of elastic members to each other using the backing plate placed across said expansion gap over said pair or pairs of elastic members, and fixing the elastic member or members on one side of the expansion gap to the inside of the step on said one side in detachable fashion;

then pressing the thus fixed elastic member or members toward the travelling path axis to bring said elastic member or members deformed toward said bridge girder axis; and thereafter fixing the elastic member or members on the other side of the expansion gap to the inside of the step on said other side in detachable fashion.

12. The method of mounting the elastic member in the vehicle traveling path joints having the expansion function according to claim 11, wherein one or more than one intermediate joint block is mounted inside said pair of steps with said joint block between.

13. The method of mounting the elastic member in the vehicle traveling path joints having the expansion function according to claim 12, wherein said joint block and said one or more than one intermediate joint block are of concrete or high-strength fiber-reinforced concrete.

14. The method of mounting the elastic member in the vehicle traveling path joints having the expansion function according to claim 11, wherein more than one supporting block is mounted inside said pair of steps with said joint block between.

15. The method of mounting the elastic member in the vehicle traveling path joints having the expansion function according to claim 14, wherein one or more than one intermediate joint block is mounted inside said pair of steps with said joint block between.

16. The method of mounting the elastic member in the vehicle traveling path joints having the expansion function according to claim 15, wherein said more than one supporting block, said joint block and said one or more than one intermediate joint block are of concrete or high-strength fiber-reinforced concrete.

17. The method of mounting the elastic member in the vehicle traveling path joints having the expansion function according to claim 11, wherein an expansion gap in a joint portion between each of said traveling path ends and said joint block is formed obliquely with respect to the axial direction of the traveling path.

18. The method of mounting the elastic member in the vehicle traveling path joints having the expansion function according to claim 17, wherein one or more than one intermediate joint block is mounted inside said pair of steps with said joint block between, said joint block and said one or more than one intermediate joint block are of concrete or high-strength fiber-reinforced concrete.

19. The method of mounting the elastic member in the vehicle traveling path joints having the expansion function according to claim 17, wherein more than one supporting block is mounted inside said pair of steps with said joint block between, one or more than one intermediate joint block is mounted inside said pair of steps with said joint block between.

20. The method of mounting the elastic member in the vehicle traveling path joints having the expansion function according to claim 19, wherein said more than one supporting block, said joint block and said one or more than one intermediate joint block are of concrete or high-strength fiber-reinforced concrete.

* * * * *